US007670185B2

(12) United States Patent
Zhang et al.

(10) Patent No.: US 7,670,185 B2
(45) Date of Patent: Mar. 2, 2010

(54) ELECTRICAL CONNECTOR WITH SHELL

(75) Inventors: Jian-Bin Zhang, ShenZhen (CN); Ji-En Long, ShenZhen (CN); Wei-Nan Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/077,096

(22) Filed: Mar. 17, 2008

(65) Prior Publication Data

US 2008/0227335 A1 Sep. 18, 2008

(30) Foreign Application Priority Data

Mar. 16, 2007 (CN) ..... 2007 2 0035424

(51) Int. Cl.
*H01R 24/00* (2006.01)

(52) U.S. Cl. ..... 439/630

(58) Field of Classification Search ..... 439/630, 439/159

See application file for complete search history.

(56) References Cited

U.S. PATENT DOCUMENTS

| | | | | |
|---|---|---|---|---|
| 6,805,570 | B1 * | 10/2004 | Lee | 439/326 |
| 7,040,928 | B1 * | 5/2006 | Lai et al. | 439/630 |
| 7,063,571 | B2 * | 6/2006 | Yu | 439/630 |
| 7,086,904 | B1 * | 8/2006 | Kuan et al. | 439/630 |
| 7,090,546 | B2 * | 8/2006 | Zheng et al. | 439/862 |
| 7,094,106 | B2 * | 8/2006 | Yamamoto et al. | 439/630 |
| 7,101,227 | B2 * | 9/2006 | Kuo | 439/630 |
| 7,104,820 | B1 * | 9/2006 | Lu et al. | 439/159 |
| 7,128,612 | B2 * | 10/2006 | Chang et al. | 439/630 |
| 7,329,134 | B2 * | 2/2008 | Hsu | 439/159 |
| 7,335,039 | B2 * | 2/2008 | Wang et al. | 439/159 |
| 7,416,429 | B1 * | 8/2008 | Hung | 439/188 |
| 7,422,485 | B2 * | 9/2008 | Yu et al. | 439/630 |
| 2003/0119364 | A1 * | 6/2003 | Liu | 439/630 |
| 2005/0130499 | A1 * | 6/2005 | Zheng et al. | 439/630 |
| 2005/0245136 | A1 * | 11/2005 | Yin et al. | 439/630 |

* cited by examiner

*Primary Examiner*—T C Patel
*Assistant Examiner*—Vladimir Imas
(74) *Attorney, Agent, or Firm*—Ming Chieh Chang; Wei Te Chung; Andrew C. Cheng

(57) ABSTRACT

An electrical connector (1) includes an insulative housing (2) having upper and lower surfaces, with a plurality of passageways (not label) extending therebetween, the insulative housing (2) further including longitudinal ends each form a block (212) with an end surface thereof; a plurality of contacts (3) assembled to the passageways, each including a contact engaging portion (not label) extending above the upper surface; metal shell (4) attached to the housing (2) and defining a receiving space with the upper surface of the housing (2), the metal shell (4) including an end tab (not label) corresponding to end surface of the block (212). The block (212) comprises a vertical stopper (2120) and a horizontal stopper (2121) extending from the underside of the vertical stopper (2120). While assembling the metal shell (4) to the insulative housing (2), the vertical stopper (2120) fastens the metal shell (4) in the horizontal direction, and the horizontal stopper (2121) fastens the metal shell (4) in the vertical direction, thereby the insulative housing (2) fastens with the metal shell (4) stably.

2 Claims, 3 Drawing Sheets

ELECTRICAL CONNECTOR WITH SHELL

BACKGROUND OF THE INVENTION

1. Field of the Invention

The present invention generally relates to an electrical connector, and more particularly to an electrical connector for receiving an electrical card therein.

2. Description of Related Art

Taiwan. Pat. NO TWM 291105 disclosed an electrical connector for receiving an electrical card therein. The electrical connector comprises an insulative housing, a metal shell and several terminals. The metal shell overcasts the top of the insulative housing, and a card receiving space formed between the insulative housing and the metal shell. The metal shell defines a through hole respectively in two sides thereof, and the insulative housing defines a button corresponding to aforementioned through hole. While the electrical card inserting into the connector, the metal shell and the insulative housing is kept steadily by the cooperation of the through hole and the button.

However, the precision of the through hole and button usually occurred error in the factual manufacture. The vertical size of the through hole is bigger than the button, the metal shell may slide downwardly due to the earth gravitational. While the horizontal size of the through hole is bigger than the button, the metal shell may slide along horizontal direction. When the size of the through hole is bigger than the button in every angle, the metal shell may slide towards each direction, the metal shell can't fasten to the insulting housing firmly.

Hence, an improved electrical connector with a metal shell is highly desired to overcome the disadvantages of the related art.

SUMMARY OF THE INVENTION

Accordingly, an object of the present invention is to provide an electrical connector with improved structure to make it more firmly to assemble a metal shell to an insulted housing.

In order to achieve the object set forth, an electrical connector in accordance with the present invention comprises an insulative housing having upper and lower surfaces, with a plurality of passageways extending therebetween, the insulative housing further including longitudinal ends each form a block with an end surface thereof; a plurality of contacts assembled to the passageway, each including a contact engaging portion extending above the upper surface; a metal shell attached to the housing and defining a receiving space with the upper surface of the housing, the metal shell including an end tab corresponding to end surface of the block. The block comprises a vertical stopper and a horizontal stopper extending from the underside of the vertical stopper.

While assembling the metal shell to the insulative housing, the vertical stopper retained the stopper in horizontal direction, the horizontal stopper carried on the metal shell, and prevented the metal shell from sliding downwardly, thereby, the metal shell installed the insulative housing steadily.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
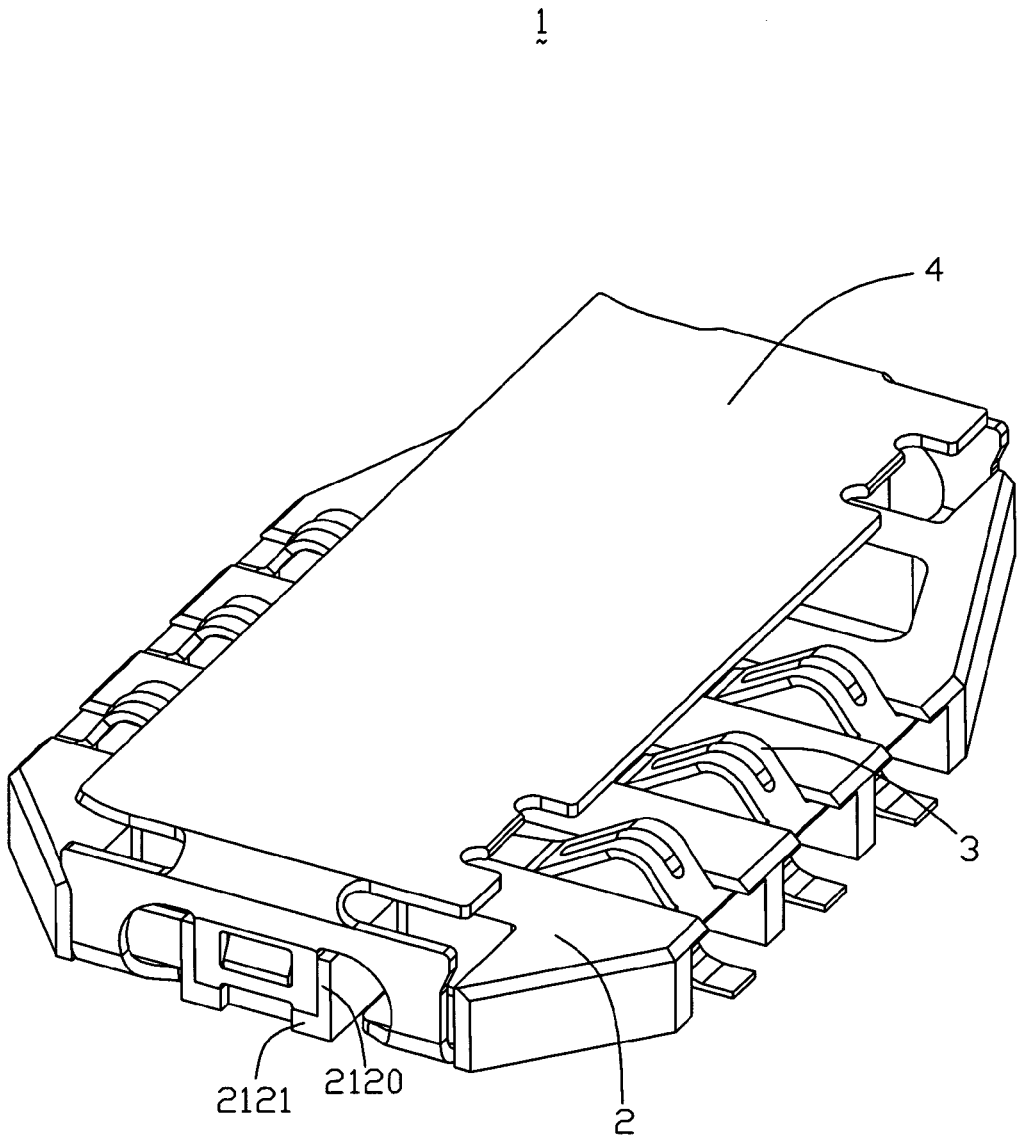
FIG. 1 is an assembled, perspective view of the electrical connector in accordance with the first embodiment of the present invention.

Referring to FIG. 1, an electrical connector 1 for an electrical card (not shown) inserting comprising an insulative housing 2, a plurality of contacts 3 respectively arranged in two rows along a vertical direction and received in the insulative housing 2, and a metal shell 3 assembled to the insulative housing 4.

Figure 2:
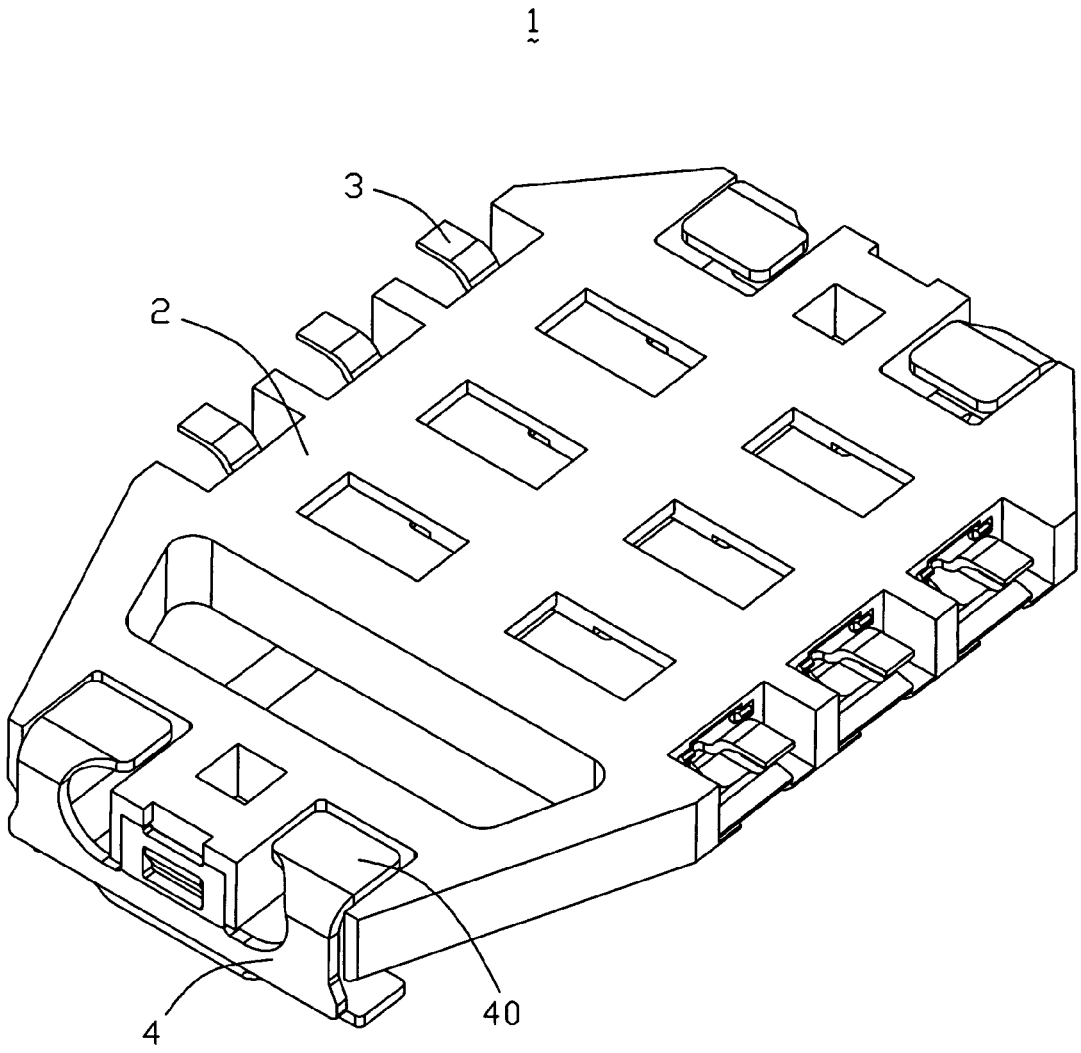
FIG. 2 is a view similar to FIG. 1, but viewed from another aspect.
Figure 3:
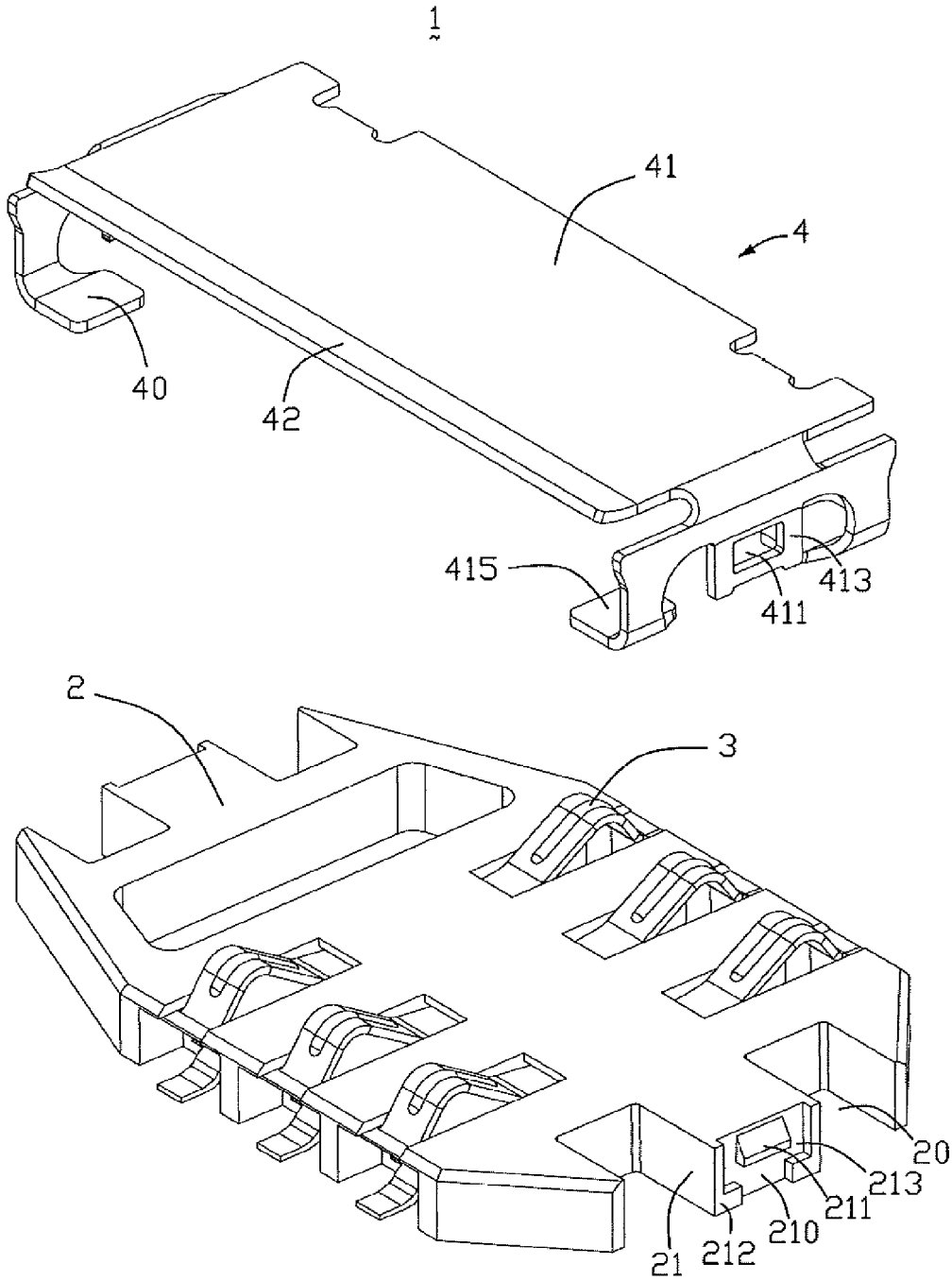
FIG. 3 is an exploded, perspective view of the electrical connector.

Referring to FIGS. 2-3, the insulative housing 2 presents rectangle approximately, the insulative housing having upper and lower surfaces, with a plurality of passageways (not labeled) extending therebetween, a pair of flutes or recesses 20 formed in two longitudinal sides of the insulative housing 2 respectively, a protuberance 21 formed between two part of the flutes or recesses 20 and molded in the insulative housing 2. The free end of the protuberance 21 defines a side 210. The approximately center of the side 210 defines a retainer 211 assorted with metal shell 4, a block 212 formed adjacent to two sides of the retainer 211 respectively. Taking the retainer 211 as the symmetrical center; two block 212 formed symmetrically each other. A trough 213 is formed between the retainer 211 and block 212. Said block 212 formed a vertical stopper 2120 extending along vertical direction, and a horizontal stopper 2121 extending along horizontal direction.

A plurality of contacts 3 assembled to the passageways, each including a contact engaging portion (not label) extending above the upper surface of the insulative housing 2;

A metal shell 4 covers on the top of the insulative housing 2, a receiving room (not labeled) for receiving the electrical card therein formed between the upper surface of the insulative housing 2 and the metal shell 4. The upside part 41 of metal shell 4 defines a warp 42 for the electrical card inserting with said receiving room easily. Two relative sides of the metal shell 4 is curved downwardly to form a pair of hooks 40 each with a solder pad 415 cooperating with the flutes or recesses 20 respectively. The free end of the solder pad 415 extends towards inside of the flutes or recesses 20. A window 411 is formed between two same sides of the hook 40, and cooperative to the retainer 211 of the insulative housing 2. Two side of the window 411 formed supporting arm 413 cooperating with the trough 213.

When assembly, the metal shell is depressed, and fixed up two sides of the insulative housing, the supporting arm 413 embeds the trough 213 steadily, the vertical stopper 2120 sustains the supporting arm 413 tightly in horizontal direction, and the horizontal stopper 2121 sustains the supporting arm 413 in vertical direction. The hook 40 is posted into the flute 20 of the insulative housing 2. The connector 1 is finished thereby.

While a pair of hooks 20 existed in this actualized manufacturing mode, a gap(not label) formed between two horizontal stopper 2121, two horizontal stopper 2121 jointed together, or the vertical stopper 2120 separated from the horizontal stopper 2121 respectively in the other actualized manufacturing mode. The shape of the block 212 is determined by the shape of the supporting arm 413. For example, the supporting arm 413 takes on the shape of the block 212, the block 212 was designed to suitable to the supporting arm. 413 accordingly.

In this present invention, when assembly, the block 212 cooperative with the metal shell 4 except the retainer 211 mating with the window 411. The retainer 211 fastened with the metal shell 4 in upside direction, the horizontal stopper 2121 carried on the metal shell 4 in underside direction, and the vertical stopper 2120 sustained with the metal shell 4, the insulative housing 2 and metal shell 4 fastened firmly accordingly.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining two rows of passageways on two longitudinal sides and two opposite retention sections on two lateral sides;

a plurality of terminals dispose in the corresponding passageways, respectively;

a pair of retention devices respectively mounted to the corresponding retention sections, each of said retention devices including a center locking hole latchably engaged with a center protrusion on the corresponding retention section, and a pair of solder pads located by two sides of the center locking hole and received in corresponding recesses which are located by two sides of the center protrusion, wherein the pair of retention devices are linked by a plate covering a top face of the housing, and a dimension of the plate along a front-to-back direction is similar to that of the retention device while is larger than that of a linking dimension between the plate and the retention device.

2. The electrical connector as claimed in claim 1, wherein said recess is outwardly toward an exterior in a lateral direction perpendicular to said front-to-back direction.

* * * * *